US006691843B2

(12) United States Patent
Nykoluk et al.

(10) Patent No.: US 6,691,843 B2
(45) Date of Patent: Feb. 17, 2004

(54) PROTECTIVE CARRYING CASE

(75) Inventors: Cory O. Nykoluk, St. Louis, MO (US); Kathleen M. Morrison, Dittmer, MO (US); Mark B. Nordstrom, Brentwood, TN (US)

(73) Assignee: TRG Accessories, LLC, St. Louis, MO (US)

( * ) Notice: Subject to any disclaimer, the term of this patent is extended or adjusted under 35 U.S.C. 154(b) by 0 days.

(21) Appl. No.: 09/800,838

(22) Filed: Mar. 7, 2001

(65) Prior Publication Data

US 2002/0125092 A1 Sep. 12, 2002

(51) Int. Cl.[7] ..... A45C 13/36
(52) U.S. Cl. ..... 190/127; 206/586
(58) Field of Search ..... 190/127, 109, 190/110, 117, 18 R; 206/320, 583, 701

(56) References Cited

U.S. PATENT DOCUMENTS

| | | | | | |
|---|---|---|---|---|---|
| 1,721,427 | A | | 7/1929 | Aldrich | |
| 2,018,605 | A | | 10/1935 | Craig | |
| 2,653,709 | A | | 9/1953 | Cunningham et al. | |
| 3,185,198 | A | * | 5/1965 | Bryan | 169/91 |
| 4,378,866 | A | | 4/1983 | Pelavin | |
| 4,784,248 | A | | 11/1988 | Workman | |
| 4,946,036 | A | | 8/1990 | Kupersmit | |
| 5,160,001 | A | | 11/1992 | Marceau | |
| 5,211,716 | A | | 5/1993 | Tobias | |
| 5,217,119 | A | | 6/1993 | Hollingsworth | |
| 5,524,754 | A | | 6/1996 | Hollingsworth | |
| 5,607,054 | A | | 3/1997 | Hollingsworth | |
| 5,639,004 | A | * | 6/1997 | Carlton et al. | 224/579 |
| 5,678,666 | A | * | 10/1997 | Shyr et al. | 190/102 |
| 5,725,090 | A | | 3/1998 | Vermillion et al. | |
| 5,775,497 | A | * | 7/1998 | Krulik | 123/406.51 |
| 5,808,865 | A | | 9/1998 | Alves | |
| 5,967,270 | A | * | 10/1999 | Shyr | 190/109 |
| 6,105,764 | A | | 8/2000 | Scicluna et al. | |
| 6,105,766 | A | * | 8/2000 | Chuang | 206/320 |
| 6,131,734 | A | | 10/2000 | Hollingsworth et al. | |
| 6,237,766 | B1 | | 5/2001 | Hollingsworth | |
| 2002/0125156 | A1 | | 9/2002 | King | |

FOREIGN PATENT DOCUMENTS

| | | |
|---|---|---|
| GB | 146601 | 7/1920 |
| WO | WO 02/070373 A1 | 9/2002 |

* cited by examiner

*Primary Examiner*—Nathan J. Newhouse
*Assistant Examiner*—Lien Ngo
(74) *Attorney, Agent, or Firm*—Lewis, Rice & Fingersh, L.C.

(57) ABSTRACT

A compact case that can be manually carried or carried in another case, for example a brief case, is designed to protect fragile, delicate objects such as laptop computers contained in the case from side impacts of bumping or from dropping the case without appreciably detracting from the compact size of the computer carried in the case.

32 Claims, 5 Drawing Sheets

PROTECTIVE CARRYING CASE

BACKGROUND OF THE INVENTION (1) Field of the Invention

The present invention pertains to a compact carrying case that is designed to protect fragile, delicate objects, for example laptop or notebook computers from damage resulting from impacts due to bumping of the case as it is carried or due to dropping the case. More specifically, the present invention pertains to a compact case that can be manually carried or carried in another case, for example a brief case, that is designed to protect laptop computers should the case itself or the briefcase in which it is being carried be struck by an object from the side or be dropped.

(2) Description of the Related Art

The use of laptop or notebook computers in business and in personal use has become widespread. The popularity of laptop computers is due in large part to their reduced size which makes them easily transportable. As a result, laptop computers are not only often transported by the individual between their home and place of business, but are also often transported by the individual whose business requires them to travel to different sites daily, as well as by the individual going on a business trip or a vacation pleasure trip.

Developments in the design of laptop and/or notebook computers include the continued reduction in their size which contributes to the ease in transporting the computer from place to place. These reduced size computers can be easily carried in one hand, tucked under an arm or in a brief case or portfolio without taking up much space. However, the reduction in size of laptop computers has also contributed to the fragility of the computer if bumped against an object or dropped, which could result in breaking the plastic enclosure common among laptop computers as well as causing damage to the delicate electronic components of the computer. This has resulted in the design of carrying cases specifically for laptop computers.

A typical computer carrying case is constructed with padding, for example foam padding, at the sides of the carrying case and primarily along the bottom of the carrying case where impact will likely occur if the carrying case is being manually transported and inadvertently dropped. However, the disadvantage associated with this type of carrying case is that the padding of the case increases the overall size of the case, which detracts from the desirable compactness of the laptop computer that makes it easily transportable.

What is needed to overcome this disadvantage of prior art protective carrying cases is a carrying case constructed to protect delicate objects enclosed in the case, for example a laptop or notebook computer, from impacts on the sides of the case when carried and primarily from impact when the case is inadvertently dropped while being manually carried, without appreciably detracting from the compactness of the computer and its transportability.

SUMMARY OF THE INVENTION

The present invention overcomes disadvantages associated with prior art protective carrying cases for laptop computers and other delicate, fragile objects by providing a protective carrying case that protects objects carried in the case from impacts against the sides of the case and primarily from an impact against the bottom of the case when dropped, without relying on bulky layers of padding along the sides and bottom of the case that detract from the compactness and transportability of the object carried by the case.

The carrying case of the invention is basically comprised of an outer, semirigid enclosure that has an interior volume that contains a protective pouch or sleeve. The sleeve is less rigid than the outer enclosure and is dimensioned to receive the fragile object, for example a laptop computer.

The outer enclosure has a rectangular block configuration that is slightly larger than the laptop computer to be contained in the enclosure. It is constructed of first and second, or front and rear, semirigid panels. When the enclosure is positioned upright the front and rear panels are positioned side by side and are slightly spaced from each other. Mutually opposed interior surfaces of the panels define the interior volume of the enclosure. The interior surfaces of the panels are constructed of a softer material than the exterior surfaces of the panels. The spacing of the panels gives the enclosure a top opening between the top ends of the front and rear panels. A closure strap is secured to the rear panel and extends across the top opening to the front panel. A releasable fastener secures the closure strap to the front panel.

The protective pouch or sleeve is comprised of first and second rectangular sheets that are secured to the top ends of the front and rear panels, respectively. The sheets depend downwardly into the interior volume of the enclosure defined by the panels. In the preferred embodiment, the first and second sheets are secured together along their side edges forming the sheets into a tubular sleeve. The sleeve has a top opening at the top of the front and rear panels and a bottom opening adjacent the bottoms of the panels.

A plurality of straps are secured to the bottom end of the sleeve. In the preferred embodiment, the straps are elastic straps. The straps are arranged in two groups or sets. Straps of one set have their top ends secured to the bottom of the first sheet of the sleeve and their bottom ends secured to the bottom of the rear panel of the enclosure. Straps of the second set have their top ends secured to the bottom of the second sheet of the sleeve and their bottom ends secured to the bottom end of the front panel. The front and rear panels are connected together only by the top end of the sleeve, the bottom ends of the two sets of straps and the closure strap. Straps of the first and second sets are arranged side by side in an alternating pattern, interweaving the straps of the first and second sets across the bottom opening of the sleeve. The interweaving of the straps of the first and second sets across the bottom opening of the sleeve defines a bottom of the sleeve on which rests the computer or other object inserted into the sleeve.

In a modification of the preferred embodiment the plurality of straps are modified to accept and support an elongate cushion member. In the modified embodiment only the plurality of straps are different. The front and rear panels and the sleeve remain the same. In addition, the modified straps include first and second sets of straps that are arranged side by side in an alternating pattern, interweaving the straps of the first and second sets across the bottom opening of the sleeve.

The plurality of straps of the modified embodiment are different in that each strap is a doubled up strap with two overlapping lengths between the top and bottom ends of the strap. The two overlapping lengths are secured together at the top and bottom ends of the strap by the same stitching that connects the top end of the strap to the sleeve and the bottom end of the strap to one of the front and rear panels. This enables the two overlapping lengths of each strap to be pulled apart and separated from each other exposing a void between the two overlapping lengths of each strap. The elongate cushion of the modified embodiment is inserted through the voids between the overlapping lengths of each of the straps of the plurality of straps. In this manner, the elongate cushion is suspended below the sleeve and above the bottom edges of the front and rear panels by the plurality of straps. In a preferred embodiment the elongate cushion is a cylindrical foam rod that is interweaved in the plurality of straps by being inserted through the voids between the two overlapping lengths of each strap. With the cushion suspended by the straps below the sleeve and above the bottom edges of the front and rear panels, the cushion provides further protection to the contents of the sleeve when the carrying case is dropped and impacts along the bottom edges of the front and rear panels.

In use, with the carrying case in its upright position, the computer or other object is inserted through the top opening of the enclosure defined by the front and rear panels and through the top opening of the sleeve. The computer is inserted downward through the sleeve until the computer passes through the bottom opening of the sleeve and rests on the interweaved straps. The computer is suspended above the bottom ends of the front and rear panels by the sleeve and the interweaved straps connected between the bottom end of the sleeve and the bottom ends of the front and rear panels. The front and rear semirigid panels protect the computer from impacts against the sides of the carrying case. The interweaved straps, being constructed from elastic straps, resiliently suspend the computer in the case and protect it from impact with the bottom of the carrying case when the case is inadvertently dropped. The cushion of the modified embodiment provides further protection to the computer when the case is dropped.

Thus, the carrying case of the present invention provides protection to a delicate, fragile object such as a laptop computer without appreciably detracting from the compactness of the computer by surrounding it with thick layers of padding.

BRIEF DESCRIPTION OF THE DRAWINGS

Further objects and features of the invention are revealed in the following detailed description of the preferred embodiment of the invention and in the drawing figures wherein.

DETAILED DESCRIPTION OF THE PREFERRED EMBODIMENT

Figure 1:
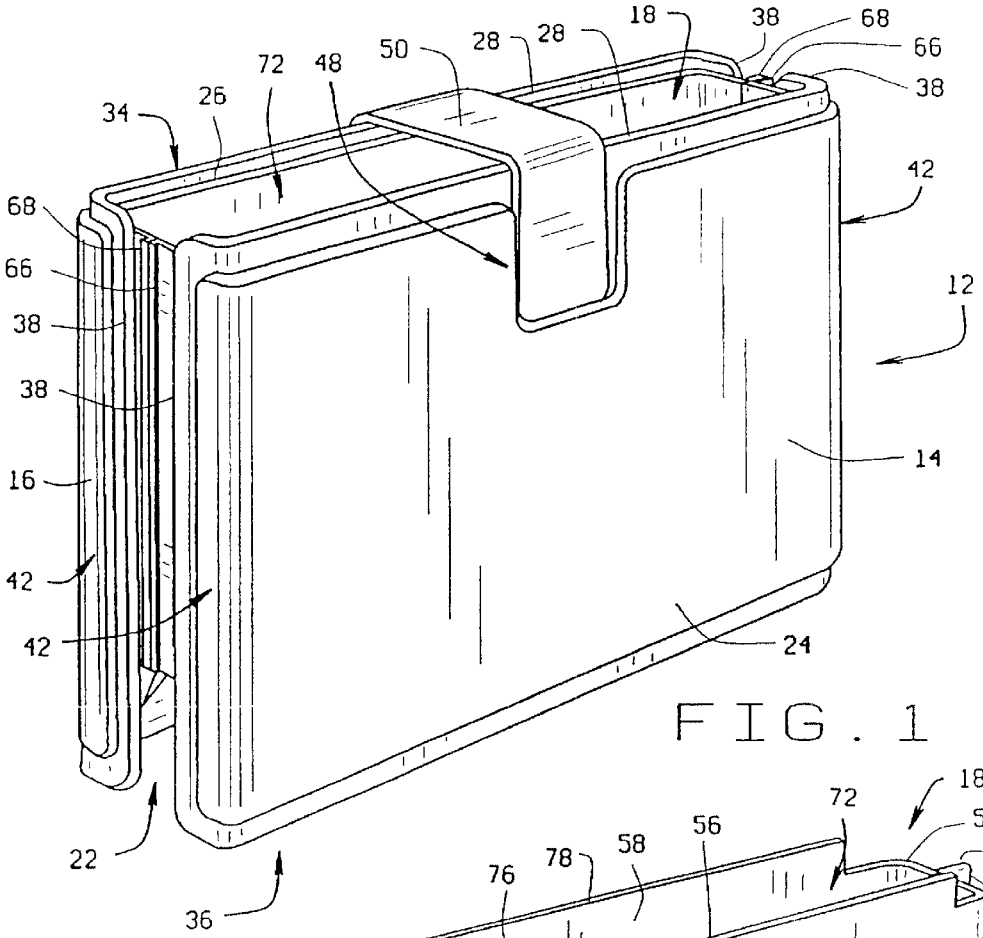
FIG. 1 is a perspective view of the carrying case of the invention shown in its upright orientation.

The carrying case 12 of the invention is shown in FIGS. 1 and 7 through 10. The carrying case 12 is basically comprised of a front or first panel 14, a rear or second panel 16, a pouch or sleeve 18 and a plurality of elastic straps 22. The particular size of the carrying case 12 will vary depending on the size of the object, for example a laptop or notebook computer, intended to be transported in the case. However, as will be explained, the width of the carrying case 12 conforms to the width of the object inserted into the case and therefore, in the preferred embodiment of the case that is intended to be used in transporting a laptop computer, the case will be dimensioned just slightly larger than the computer. Although the preferred embodiment of the case is designed for transporting a laptop computer, it should be understood that the case may be used in transporting and protecting other delicate, fragile objects.

Figure 6:
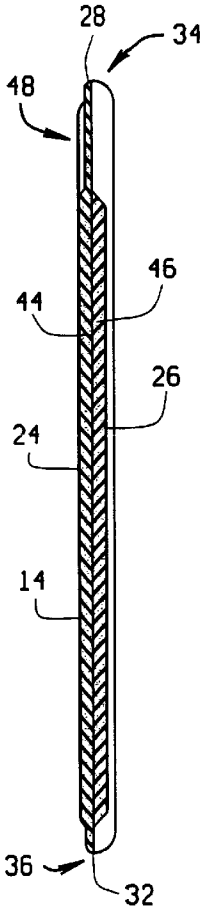
FIG. 6 is a view similar to that of FIG. 5 in a plane of the line 6—6 of FIG. 3.
Figure 5:
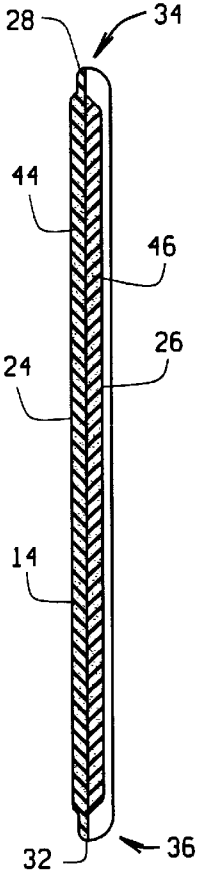
FIG. 5 is a side elevation view of the panel of FIG. 3 in a plane of the line 5—5 of FIG. 3.
Figure 3:
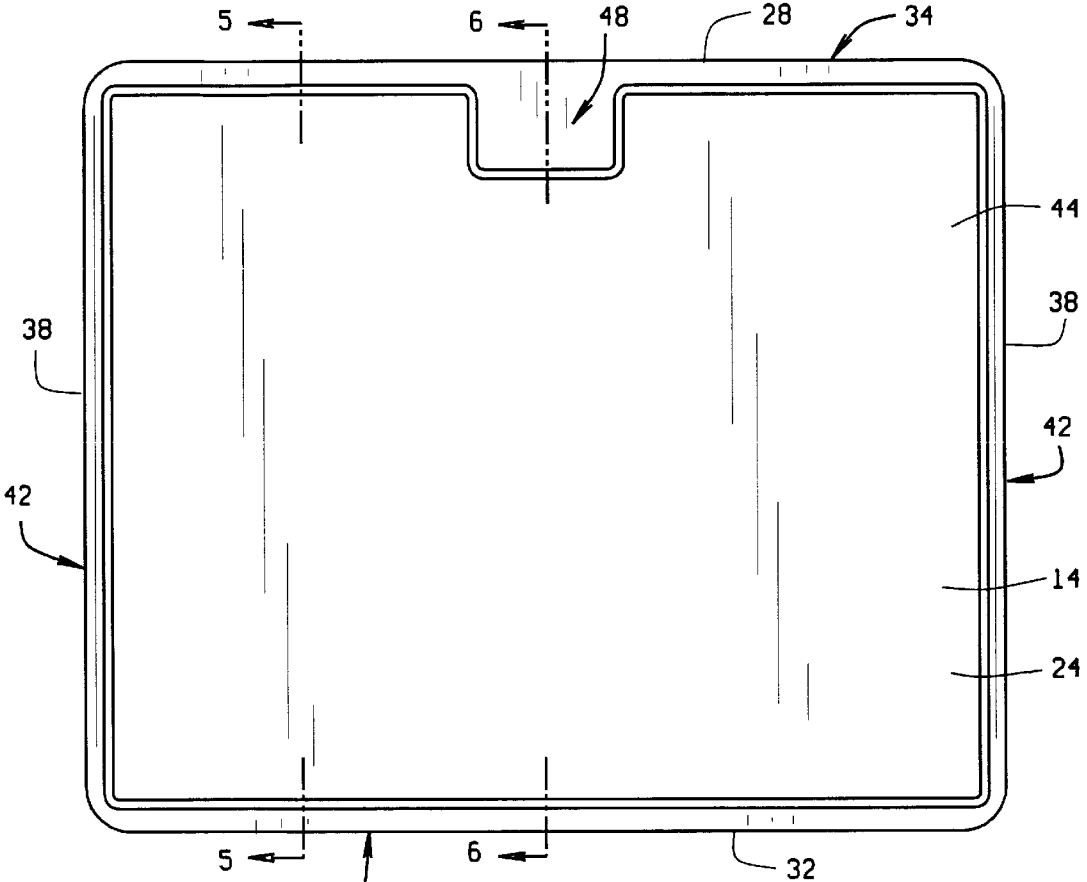
FIG. 3 is a front elevation view of one of the panels of the enclosure.
Figure 4:
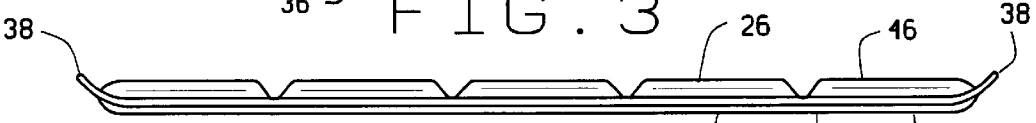
FIG. 4 is a top plain view of the panel of FIG. 3.
Figure 7:
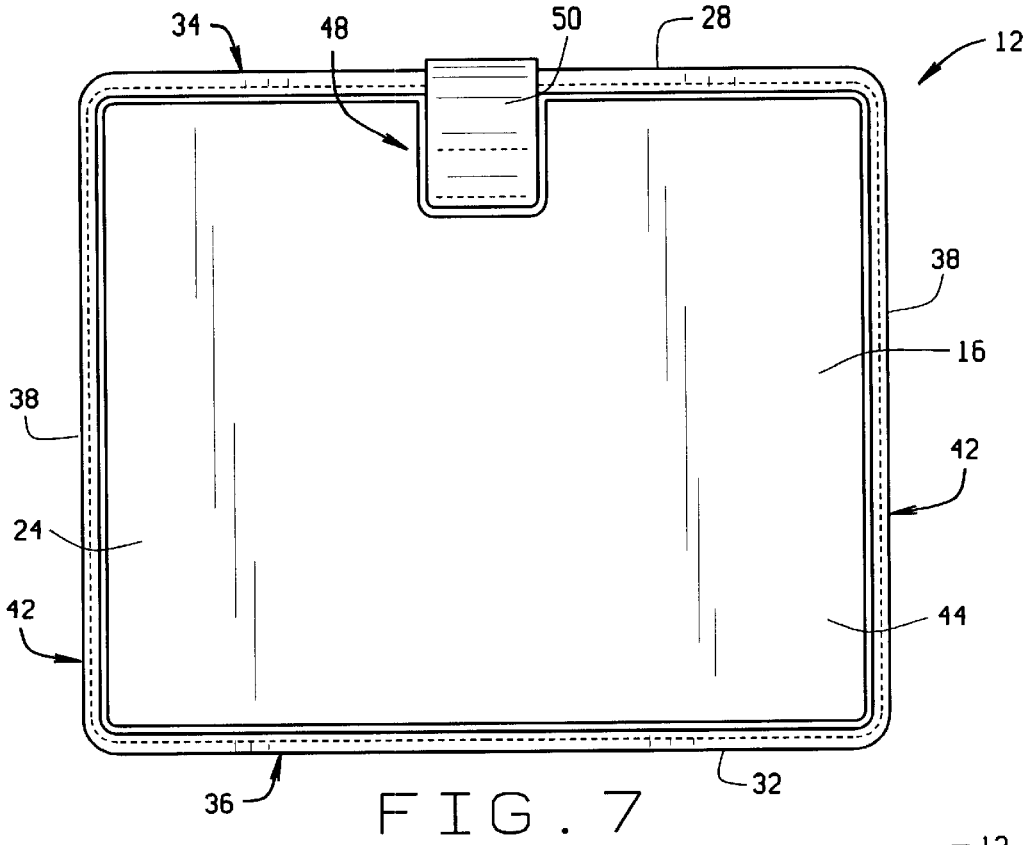
FIG. 7 is a front view of the assembled carrying case.
Figure 8:
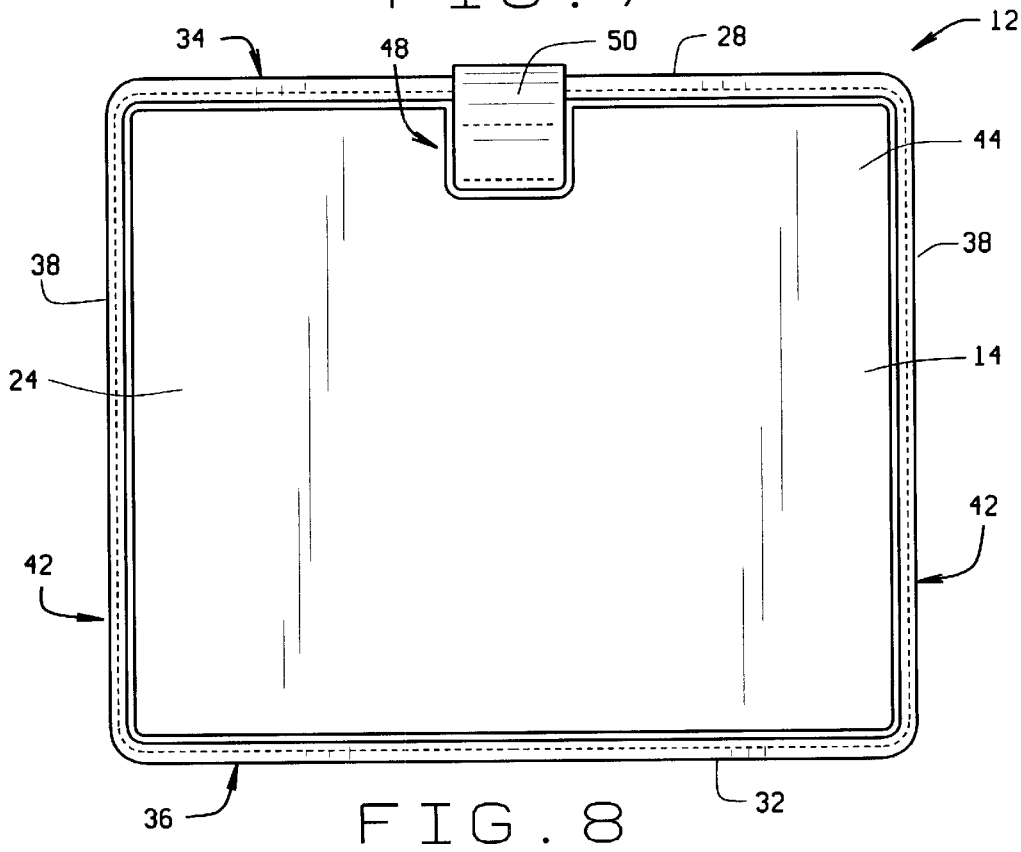
FIG. 8 is a rear view of the carrying case.
Figure 9:
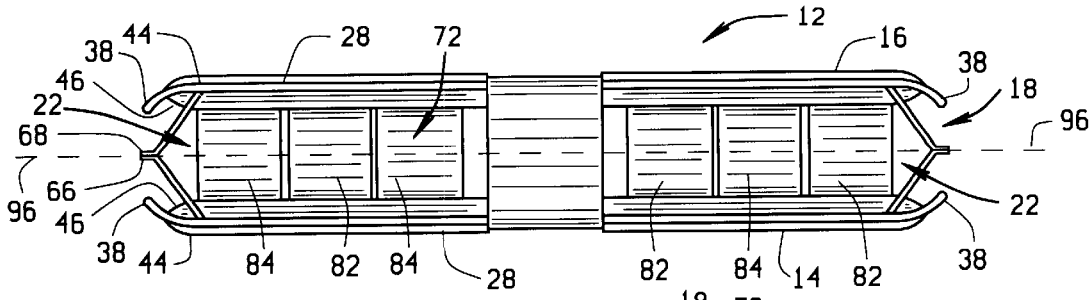
FIG. 9 is a top plane view of the carrying case.

The front 14 and rear 16 panels have the same basic construction and therefore only the construction of the front panel 14 will be described in detail. The front panel 14 is shown removed from the carrying case 12 in FIGS. 3 through 6. Each panel 14 has a general rectangular configuration with opposite exterior 24 and interior 26 surfaces. The rectangular configuration of the panel is defined by its opposite top 28 and bottom 32 edges at respective top 34 and bottom 36 ends of the panel, and by its opposite side edges 38 at the opposite side ends 42 of the panel. The use of the terms "top", "bottom" and "side" are descriptive only and should not be interpreted as implying that the carrying case can only be used in its upright orientation shown in FIG. 1. The preferred embodiment of the panel 14 is compression molded of foam and two different types of foam are used. As seen in FIGS. 5 and 6, the panel 14 is molded with a layer 44 of a stiff durometer foam at its exterior and a layer 46 of a soft durometer foam at its interior. The layer of stiff durometer foam has a greater thickness at the center of the panel and has a reduced thickness around the perimeter edge of the panel. As seen in FIG. 4, the opposite side edges 38 of the panel 14 curve inwardly slightly. The stiff foam layer 44 is also formed with a rectangular notch 48 at the top end 34 of the panel to accommodate a closure strap 50 to be described. For appearance purposes, the thicker regions of the panel could be covered by a material such as nylon or taffeta while the thinner edges could be covered by a complementary trim material. The stiff durometer foam layer 44 makes the panel 14 semirigid and together with the soft foam layer 46 on the interior of the panel, the front 14 and rear 16 panels will protect the contents of the carrying case 12 from impacts resulting from bumps encountered in carrying the case or from dropping the case. The rear panel 16 is constructed in the same manner as the front panel 14 with there being only slight differences in the size of the strap notches 48 on each panel as can be seen in FIGS. 7 and 8.

With the carrying case 12 positioned upright as shown in FIG. 1, the interior surfaces of the two panels 14, 16 mutually oppose each other and are spaced from each other by the sleeve 18 to be described. The opposite side ends 42 of each panel curve around the sleeve 18 protecting the ends of the sleeve as well as reinforcing the panels. The two panels 14, 16 provide a semirigid outer enclosure for the sleeve 18.

An elastic closure strap 50 extends across the top edges 34 of the front and rear panels. The closure strap 50 has one end secured to the rear panel in the strap notch by adhesive, stitching or other equivalent means. The opposite end of the strap is releasably attached to the front panel 14 in the strap notch 48 by a releasable fastener such as a hook and loop type fastener, by snaps or by other equivalent type fasteners.

Figure 2:
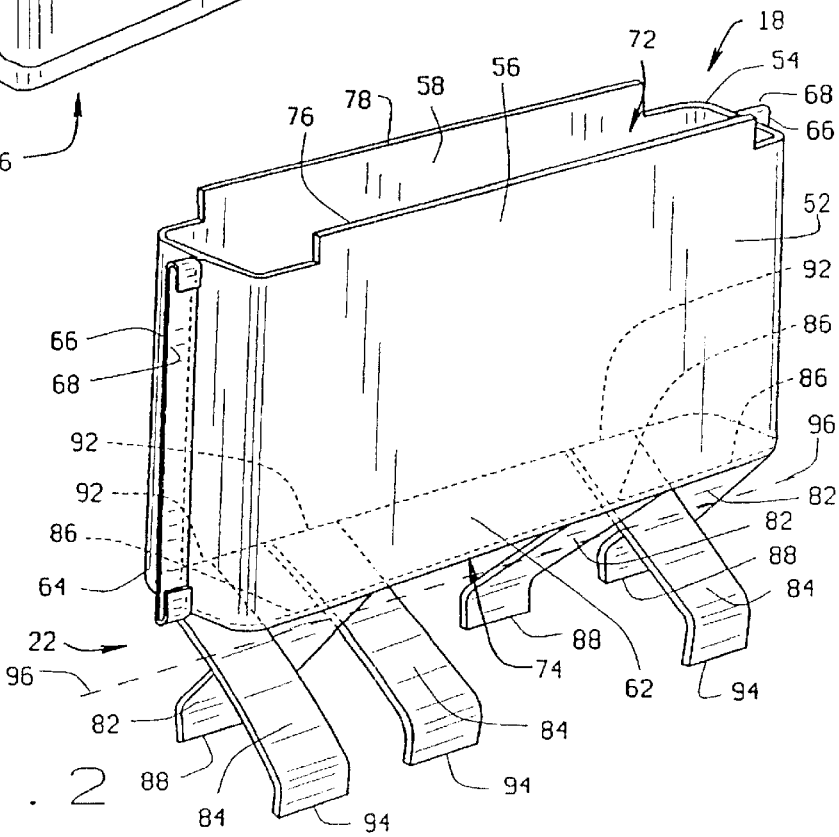
FIG. 2 is a perspective view of the inner pouch or sleeve and the interweaved straps of the carrying case removed from the outer enclosure defined by the front and rear panels.

FIG. 2 shows the sleeve 18 removed from the front and rear panels 14, 16. The sleeve 18 is basically comprised of a first sheet 52 and second sheet 54, or front sheet and rear sheet respectively, of fabric such as nylon or other equivalent fabric. Each sheet 52, 54 is generally rectangular and has opposite top 56, 58 and bottom 62, 64 ends and opposite side ends 66, 68. The opposite side ends 66, 68 of the sheets are sewn together forming the tubular sleeve 18, with the sleeve having opposite top 72 and bottom 74 openings. The seam formed by sewing together the sheet side ends 66, 68 could be covered with a ribbon of material, for example grossgrain, to enhance the appearance of the sleeve 18. Flaps 76, 78 are provided along portions of the top ends 56, 58 of the sheets. The flaps 76, 78 are secured to the top ends of the front 14 and rear 16 panels to suspend the sleeve 18 from the top ends of the panels between the panel interior surfaces 26. The connection of the flaps 76, 78 to the front and rear panels 14, 16 could be by stitching, adhesive, or other equivalent means and is the only connection between the sleeve 18 and the panels.

A plurality of suspension straps 82, 84 are connected between the bottom ends 62, 64 of the sleeve 18 and the bottom ends 36 of the panels 14, 16. The straps can be connected to the sleeve and panels by stitching, adhesives, or other equivalent means. In the preferred embodiment, the straps 82, 84 are about one and one-half inches wide and are elastic straps. The wide straps are preferred, but other types of cords, bands and webbing could be used in place of the straps. The straps are divided into a first group or set of straps 82 and a second group or set of straps 84. The first set of straps 82 each have top ends 86 that are connected to the bottom end 62 of the front sheet 52 of the sleeve 18 that in turn is connected to the top end of the front panel 14. The bottom ends 88 of the straps of the first set are connected to the bottom end 36 of the rear panel 16. The second set of straps 84 each have top ends 92 that are connected to the bottom end 64 of the rear sheet 54 of the sleeve 18 that in turn is connected to the top end 34 of the rear panel 16. The bottom ends 94 of the second set of straps 84 are connected to the bottom end 36 of the front panel 14. This gives the straps of the first and second sets 82, 84 a side by side, interweaved arrangements where the straps of the first and second sets alternate as they extend across the bottom opening 74 of the sleeve 18. The interweaved or crisscrossing arrangement of the straps can best be seen in FIGS. 2 and 10. The straps cross at a line of intersection 96 that defines the bottom of the protective sleeve 18 on which the object, for example the laptop computer, rests when inserted into the carrying case 12.

Figure 10:
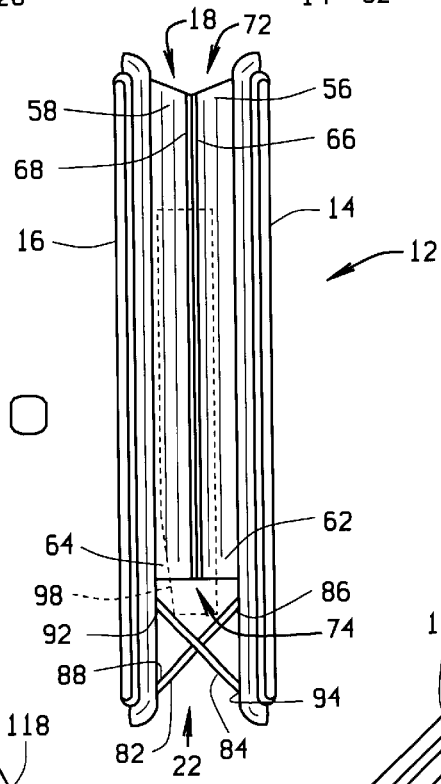
FIG. 10 is a side elevation view of the carrying case.

In use of the carrying case 12, the closure strap 50 is first detached from its coupling to the front panel 14 providing access to the top opening 72 of the sleeve 18. The object, such as the computer 98, is inserted downwardly through the sleeve top opening 72 into the interior of the sleeve 18. The computer 98, shown in dashed lines in FIG. 10, is inserted through the sleeve 18 until the bottom of the computer rests on the interweaved straps 82, 84 along their line of intersection 96 as shown in FIG. 10. The weight of the object supported on the straps 82, 84 will draw the front 14 and rear 16 panels toward each other and against the opposite sides of the object. This movement of the panels adapts the case for use with different size computers or objects. The closure strap 50 is then moved across the top of the computer 98 and the sleeve top opening 72 and its fastener is coupled to the mating fastener on the front panel 14. This securely holds the computer in the sleeve 18. The stiff durometer layer 44 of the front and rear panels 14, 16 protects the computer from bumps and impacts against the sides of the carrying case as the case is carried. The soft foam layer 46 on the interior surfaces of the front and rear panels 14, 16 cushions the computer against any bumps against the sides of the case. Should the case be dropped while carrying the computer or should the case with the computer be stored in another case, for example a brief case, and that case is dropped, the crisscrossing straps 82, 84 function as a resilient suspension and stretch and then return to their original configurations to absorb the force of impact when the bottom ends 36 of the front and rear panels 14, 16 contact the ground or the bottom of the case in which the carrying case 12 is carried. In this manner, the carrying case 12 of the invention provides lightweight protection for the computer 98 against side bumps and against damage from dropping the computer without appreciably detracting from the compact size and transportability of the computer.

Figure 11:
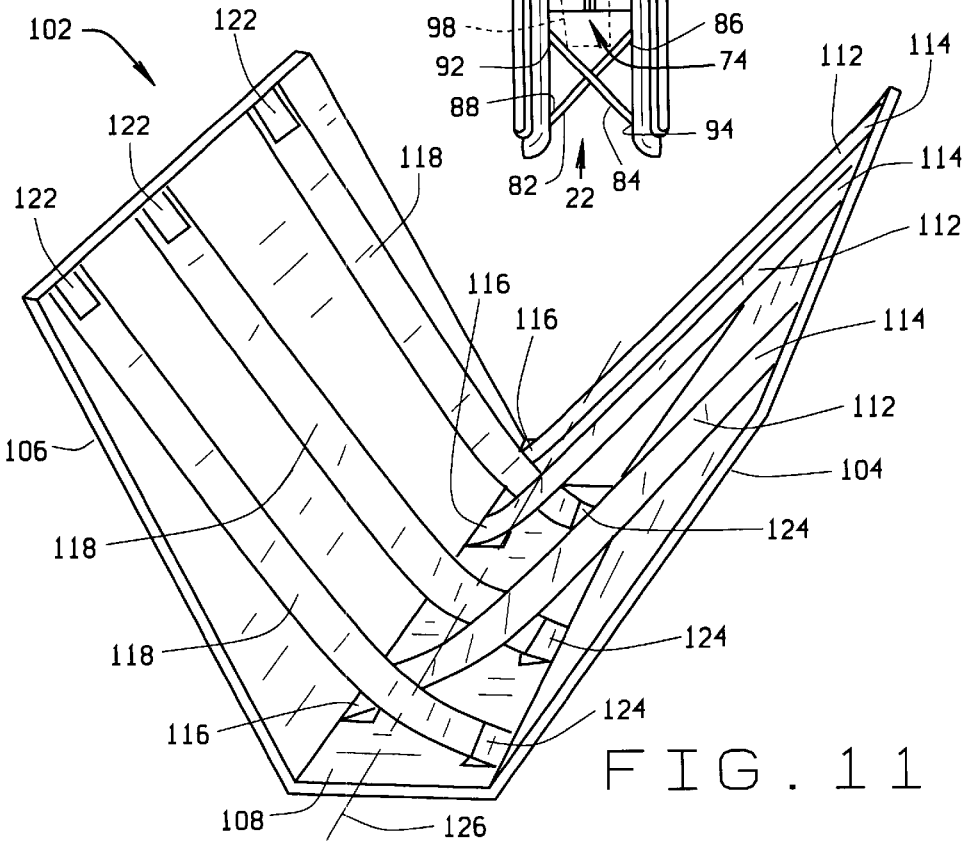
FIG. 11 is a perspective view of another embodiment of the carrying case.

FIG. 11 shows another embodiment of the carrying case. The case 102 of FIG. 11 is also constructed of a front panel 104 and rear panel 106 as in the previous embodiment, but the two panels are connected along their bottom ends by a binder panel 108. All three panels could be constructed in a similar manner to that of the front and rear panels previously described. The connection between the front 104 and rear 106 panels with the binder panel 108 enables the front and rear panels to pivot relative to the binder panel along their line of connection.

A first set of elastic straps 112 have their top ends 114 connected to the top end of the front panel 104 and their bottom ends 116 connected to the bottom end of the rear panel 106. A second set of elastic straps 118 have their top ends 122 connected to the top end of the rear panel 106 and their bottom ends 124 connected to the bottom end of the front panel 104. As in the first embodiment, the first and second sets of straps 112, 118 are arranged in an interweaved arrangement and crisscross forming a line of intersection 126 on which the computer or other object rests when carried by this second embodiment of the case 102. In this manner, the second embodiment of the case 102 functions to protect the computer from side impacts of bumping and from being dropped in the same manner as the first described embodiment of the carrying case 12.

Figure 13:
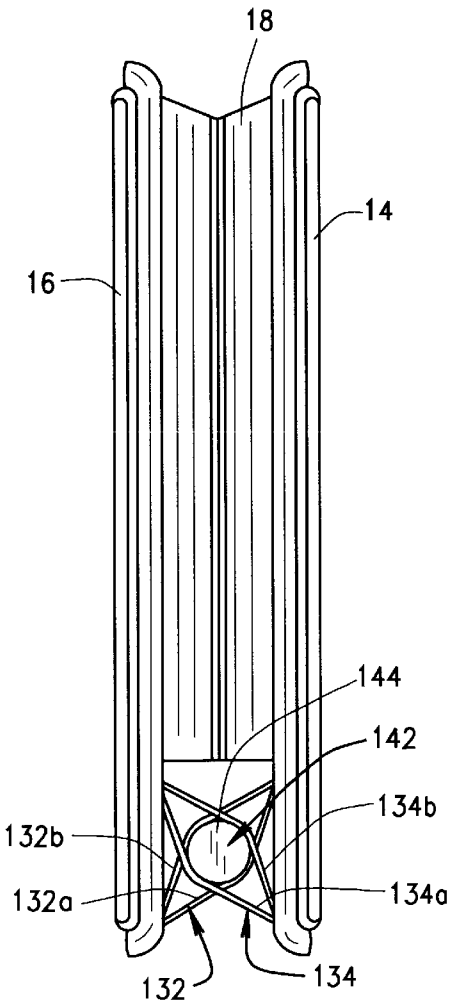
Figure 12:
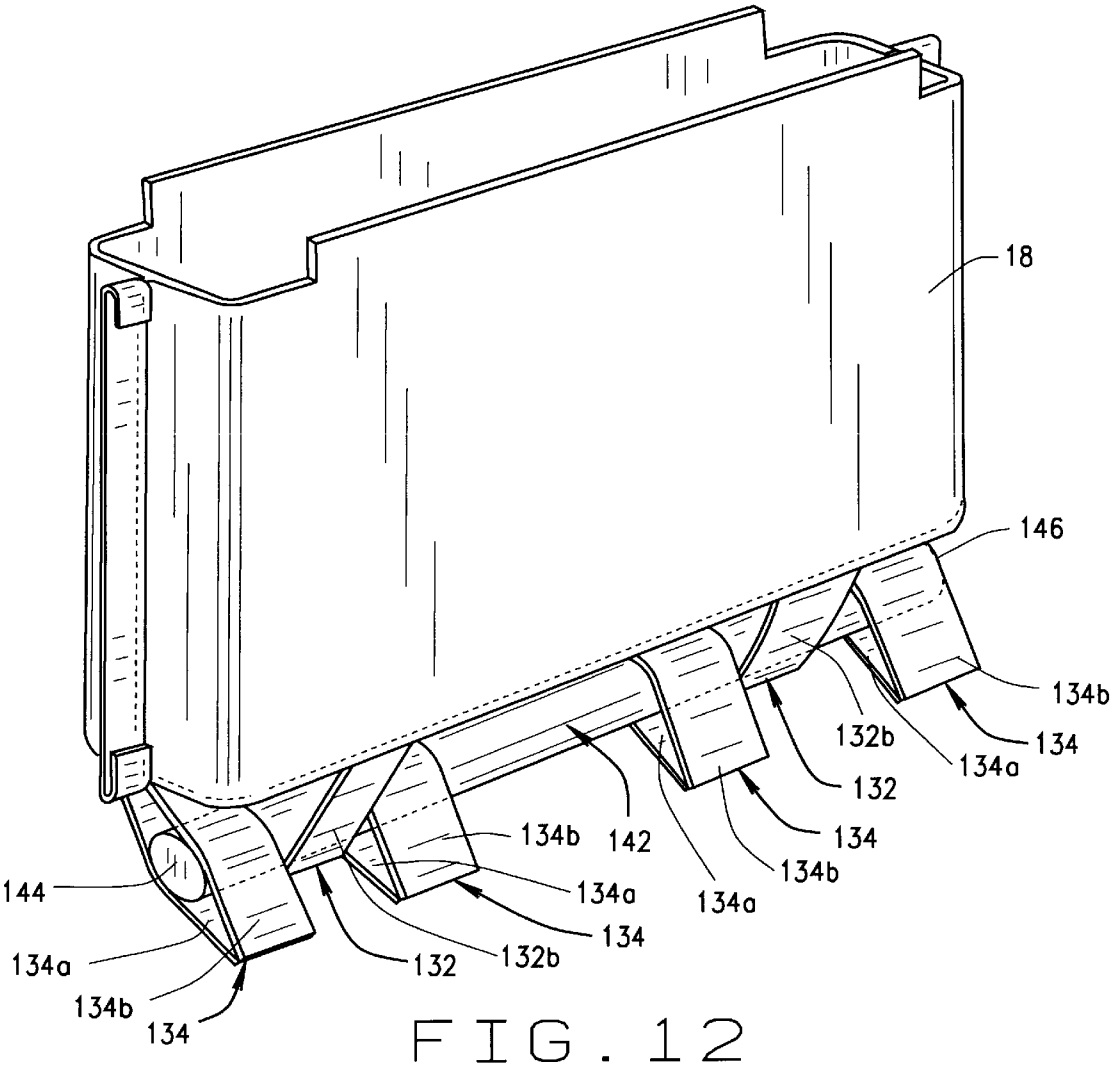
FIG. 12 is a perspective view of a further embodiment of the carrying case; and, FIG. 13 is a side elevation view of the carrying case of FIG. 12.

FIGS. 12 and 13 show a further modification to the first described embodiment of the carrying case 12. In the modified case shown in FIGS. 12 and 13, the front panel 14, rear panel 16 and sleeve 18 constructions are the same as in the first described embodiment and are identified by their same reference numbers. Because these component parts of the case are the same as the earlier described embodiment, they will not be described again.

Like the first described embodiment, the modified embodiment of FIGS. 12 and 13 is also comprised of a plurality of suspension straps 132, 134 that are connected between the bottom ends of the sleeve 18 and the bottom ends of the front and rear panels 14, 16. The straps are connected to the sleeve and the panels in the same manner as the first described embodiment. The straps are also divided into a first group or set of straps 132 and a second group or set of straps 134. The straps 132 of the first set each have top ends that are connected to the bottom end of the front sheet of the sleeve 18 that in turn is connected to the top end of the front panel 14. The bottom ends of the straps of the first set are connected to the bottom end of the rear panel 16. The second set of straps each have top ends that are connected to the bottom end of the rear sheet of the sleeve 18 that in turn is connected to the top end of the rear panel 16. The bottom ends of the second set of straps 134 are connected to the bottom end of the front panel 14. This gives the straps of the first and second sets 132, 134 a side by side, interweaved arrangement where the straps of the first and second sets alternate as they extend across the bottom opening of the sleeve 18.

The straps of the first and second sets 132, 134 of the FIGS. 12 and 13 embodiment of the carrying case differ from the straps of the first described embodiment in that each strap is a doubled up strap with two overlapping lengths between the top and bottom ends of the strap. Each strap 132 of the first set of straps is formed with two overlapping lengths 132*a*, 132*b* and each strap 134 of the second set of straps is formed with two overlapping lengths 134*a*, 134*b*. With the top ends of the straps secured to the sleeve 18 and the bottom ends of the straps secured to one of the front and rear panels 14, 16, the two lengths 132*a*, 132*b* of each strap of the first set of straps can be pulled apart from each other exposing a void 136 between the straps and the two lengths 134*a*, 134*b* of each strap of the second set of straps can be pulled apart from each other exposing a void 138 between the lengths.

The modification of the first described embodiment of the case shown in FIGS. 12 and 13 also includes an elongate cushion member 142. In the preferred embodiment the elongate cushion member 142 is formed as a cylindrical foam rod having a length between opposite ends 144, 146 that corresponds to the length of the bottom of the sleeve 18. The elongate cushion member 142 is inserted through the aligned voids between the overlapping lengths of the first and second sets of straps 132, 134. In this manner, the cushion is interweaved in the plurality of straps and supported in a position below the sleeve 18 and above the bottom edges of the front and rear panels 14, 16 by the first and second pluralities of straps 132, 134 as shown in FIGS. 12 and 13.

The cushion 142, being suspended directly below the sleeve 18, provides additional protection for the contents of the sleeve when the carrying case 12 is inadvertently dropped. It can be seen in FIG. 13 that, when the case is inadvertently dropped and impacts on the bottom edges of the front and rear panels 14, 16, the downward movement of the contents of the case through the interior of the sleeve 18 will be resisted by the elasticity of the first and second pluralities of straps 132, 134. However, if the elasticity of the straps is insufficient to halt the downward momentum of the contents of the sleeve 18, the elongate cushion member 142 is positioned to cushion any impact of the contents of the sleeve with the surface on which the carrying case is dropped.

While the present invention has been described by reference to specific embodiments, it should be understood that modifications and variations of the invention may be constructed without departing from the scope of the invention defined in the following claims.

What is claimed is:

1. A case for transporting electronic equipment such as a laptop computer, the case comprising:

a front panel having opposite exterior and interior surfaces, opposite top and bottom ends and opposite side ends;

a rear panel having opposite exterior and interior surfaces, opposite top and bottom ends and opposite side ends; said interior surfaces of said front panel and said rear panel mutually opposing each other; and a plurality of straps, said plurality including:

a first set of straps, each of said straps in said first set of straps having a top end and a bottom end wherein said top ends and said bottom ends of said straps of said first set of straps are connected to said top end of said front panel and said bottom end of said rear panel, respectively; and a second set of straps, each of said straps in said second set of straps having a top end and a bottom end wherein said top ends and said bottom ends of said straps of said second set of straps are connected to the top end of said rear panel and bottom end of said front panel, respectively;

wherein, said straps of said first set cross said straps of said second set at a line of intersection;

wherein when said electronic equipment is placed in said case, said electronic equipment is inserted between said interior surface of said front panel and said interior surface of said rear panel at said top edges of said front panel and said rear panel and is moved downward between said front panel and said rear panel towards said bottom edges of said front panel and said rear panel until said electronic equipment rests on said plurality of straps.

2. The case of claim 1, wherein each strap in both said first set of straps and said second set of straps is elastic.

3. The case of claim 1, wherein said front panel and said rear panel are semirigid.

4. The case of claim 1, further comprising:

a sleeve for receiving said electronic equipment, said sleeve being tubular and having opposite top and bottom openings at opposite top and bottom ends of said sleeve, and said sleeve having a front portion and a rear portion, each of said portions extending from said top end to said bottom end of said sleeve;

wherein said sleeve is positioned between said interior surfaces of said front panel and said rear panel;

wherein said top end of said front portion is connected to said top end of said front panel, said top end of said rear portion is connected to said top end of said rear panel, said bottom end of said front portion is connected to said top ends of said first set of straps, and said bottom end of said rear portion is connected to said top ends of said second set of straps, thereby connecting said top ends of said first set of straps to the top end of said front panel and said top ends of said second set of straps to the top end of said rear panel; and wherein when said electronic equipment is placed in said case said electronic equipment is also inserted within said sleeve at said top edges of said sleeve and is moved downward in said sleeve towards said bottom edges of said sleeve until said electronic equipment rests on said plurality of straps.

5. The case of claim 4, wherein each of said straps is elastic.

6. The case of claim 4, wherein said front panel and said rear panel are semirigid.

7. The case of claim 4, wherein a cushion is interweaved in said plurality of straps.

8. The case of claim 7, wherein said cushion is interweaved in said plurality of straps between said top end and said bottom end of each strap.

9. The case of claim 4, wherein each strap of said plurality of straps is a doubled up strap with two overlapping lengths between said top end and said bottom end of said strap.

10. The case of claim 9, wherein a cushion is positioned between said two overlapping lengths of each strap.

11. The case of claim 4, wherein said first set of straps and said second sets of straps are arranged side by side along said bottom end of both said first sheet and said second sheet.

12. The case of claim 1, herein a cushion is interweaved in said plurality of straps.

13. The case of claim 12, wherein said cushion is interweaved in said plurality of straps between said top end and said bottom end of each strap.

14. The case of claim 1, wherein each strap of said plurality of straps is a doubled up strap with two overlapping lengths between said top end and said bottom end of said strap.

15. The case of claim 14, wherein a cushion is positioned between said two overlapping lengths of each strap.

16. The case of claim 1, further comprising:

a first sheet and a second sheet positioned between said front panel and said rear panel, said first sheet connecting the top ends of said first set of straps to said top end of said front panel and said second sheet connecting said top ends of said second set of straps to said top end of said rear panel.

17. The case of claim 16, wherein:

said first sheet and said second sheet are connected together forming a tubular sleeve between said front panel and said rear panel with said tubular sleeve having opposite top and bottom openings and with said line of intersection parallel to said bottom opening.

18. The case of claim 17 wherein each of said straps is elastic.

19. The case of claim 17 wherein said front panel and said rear panel are both more rigid than both said first sheet and said second sheet.

20. The case of claim 16, wherein each of said straps is elastic.

21. The case of claim 16, wherein said front panel and said rear panel are both semirigid and are more rigid than both said first sheet and said second sheet.

22. The case of claim 1, wherein:

said first set of straps and said second sets of straps cross in an alternating side-by-side arrangement with at least one member of the first set of straps being arranged between two members of the second set of straps, and at least one member of the second set of straps being arranged between two members of the first set of straps.

23. The case of claim 1, wherein:

said top end, said bottom end and both said opposite sides of said front panel are spaced from said top end, said bottom end and said opposite sides, respectively, of said rear panel.

24. A case for transporting electronic equipment such as a laptop computer, the case comprising:

a front panel having opposite exterior and interior surfaces, opposite top and bottom ends and opposite side ends;

a rear panel having opposite exterior and interior surfaces, opposite top and bottom ends and opposite side ends;

a first sheet arranged between said front panel and said rear panel, said first sheet having opposite top and bottom ends and opposite side ends, said top end of said first sheet being connected to said top end of said front panel;

a second sheet arranged between said front panel and said rear panel, said second sheet having opposite top and bottom ends and opposite side ends, said top end of said second sheet being connected to said top end of said rear panel; and a plurality of straps connected to said bottom ends of said first sheet and said second sheet;

wherein said plurality of straps have opposite top and bottom ends and include first and second sets of straps, said top ends and said bottom ends of said first set of straps are connected to said bottom end of said first sheet and to said bottom end of said rear panel, respectively, and said top ends and said bottom ends of said second set of straps are connected to said bottom end of said second sheet and to said bottom end of said front panel, respectively forming a crossing arrangement; and wherein when said electronic equipment is placed in said case, said electronic equipment is inserted between said first sheet and said second sheet at said top end of said first sheet and said top end of said second sheet and is moved downward between said first sheet and said second sheet towards said bottom edges of said front panel and said rear panel until said electronic equipment contacts on said plurality of straps.

25. The case of claim 24, wherein said opposite side ends of said first sheet are connected to said opposite side ends of said second sheet forming a tubular sleeve with opposite top and bottom openings.

26. The case of claim 24, wherein a cushion is interweaved in said plurality of straps.

27. The case of claim 24, wherein said cushion is interweaved in said plurality of straps between said top end and said bottom end of each strap.

28. The case of claim 24, wherein each strap of said plurality of straps is a doubled up strap with two overlapping lengths between said top end and said bottom end of said strap.

29. The case of claim 28, wherein a cushion is positioned between said two overlapping lengths of each strap.

30. The case of claim 24, wherein each of said straps is elastic.

31. The case of claim 24, wherein each of said panels is semirigid.

32. The case of claim 24, wherein each of said panels is more rigid than both said first sheet and said second sheet.

* * * * *